US007192017B2

(12) United States Patent
Wang et al.

(10) Patent No.: US 7,192,017 B2
(45) Date of Patent: Mar. 20, 2007

(54) MECHANICAL SUCTION DEVICE

(75) Inventors: Yuan-Nan Wang, Houlong Chen (TW); Wu-Chiang Lin, Taipei (TW)

(73) Assignee: Anderson Industrial Corp., Taipei (TW)

( * ) Notice: Subject to any disclaimer, the term of this patent is extended or adjusted under 35 U.S.C. 154(b) by 139 days.

(21) Appl. No.: 11/108,331

(22) Filed: Apr. 18, 2005

(65) Prior Publication Data

US 2006/0231995 A1 Oct. 19, 2006

(51) Int. Cl.
*B25B 11/00* (2006.01)

(52) U.S. Cl. ..... 269/21

(58) Field of Classification Search ..... 269/21, 269/309, 310, 20; 279/3; 451/388, 412; 125/35; 294/64.1, 65; 248/262, 263
See application file for complete search history.

(56) References Cited

U.S. PATENT DOCUMENTS 4,684,113 A * 8/1987 Douglas et al. ..... 269/21
5,372,357 A * 12/1994 Blaimschein ..... 269/21
6,702,268 B1 * 3/2004 Nascimben ..... 269/21

* cited by examiner

*Primary Examiner*—Robert C. Watson
(74) *Attorney, Agent, or Firm*—Alan D. Kamrath; Nikolai & Mersereau, P.A.

(57) ABSTRACT

A mechanical suction device has a housing, multiple pneumatic cylinder assemblies, multiple air piston assemblies and a base. The housing has a side, multiple top recesses, multiple bottom recesses, multiple longitudinal air passages and multiple transverse ports. The pneumatic cylinder assemblies are mounted on the side of the housing, and each has a cylinder and a shaft valve. The air piston assemblies are mounted on the housing, and each has an air piston mounted on one of the top recesses. The shaft valves are mounted slidably and respectively inside the transverse ports. At least one of the air pistons is raised to suck one or multiple workpieces by providing air compressed into at least one of the longitudinal air passages and providing air compressed into at least one of the cylinders to move the corresponding shaft valve.

5 Claims, 12 Drawing Sheets

MECHANICAL SUCTION DEVICE

BACKGROUND OF THE INVENTION

1. Field of the Invention

The present invention relates to a suction device, and more particularly to a mechanical suction device that securely and stably holds a workpiece on a work surface with a vacuum suction so the workpiece can be processed such as precision cutting or etching of the workpiece.

2. Description of Related Art

Machining devices such as milling machines generally have a means to securely hold a workpiece in place as the workpiece is processed with a cutter or drill.

One means to hold a workpiece in place uses multiple fasteners such as clamps to fasten a workpiece of wood or metal to a worktable. However, the fasteners often mar, deform or otherwise damage the outer surface of the workpiece.

Another means to hold a workpiece on a work surface uses a vacuum suction. The suction means keeps the workpiece from being marred, deformed or otherwise damaged. Two kinds of assemblies with the suction means are jig assemblies and suction disk assemblies.

With reference to FIGS. 9 and 10, a conventional jig assembly in accordance with the prior art comprises a worktable (80) and multiple jigs (81). The worktable (80) has a top surface and a vacuum pump. The jigs (81) are mounted detachably on the top surface of the worktable (80), and each jig (81) has a top surface and multiple through holes.

The jig assembly cooperates with a processing machine such as a milling device having a cutter (83) to process one or multiple workpieces (82). In operation, the worktable (80) sucks and secures one of the jigs (81) with the vacuum suction. The workpiece (82) is mounted on the top surface of the secured jig (81) and secured by the vacuum suction through the through holes in the secured jig (81). Then, the cutter (83) starts cutting the workpiece (82).

However, the workpieces (82) has different sizes, and the jigs (81) need to be sized respectively by hand to correspond to the workpieces (82) to successfully process the workpieces (82). Sizing the jigs (81) with different sizes by hand is inconvenient and time consuming.

With reference to FIGS. 11 and 12, a conventional suction disk assembly in accordance with the prior art comprises multiple suction disks (90) arranged in multiple rows. Each suction disk (90) is hollow and has a top, a through hole and multiple air tubes (91). The through hole is defined through the top of the suction disk (90). The air tubes (91) are connected to the suck disk (90), communicate with the through hole and are connected to a suction device such as a suction pump providing a vacuum suction through the air tubes (91) and the through hole.

The suction disk assembly also cooperates with a processing machine such as a milling device having a cutter (93) to process one or multiple workpieces (92) attached to the top surfaces of the suction disks (90) by the vacuum suction. However, the suction disks (90) with the exposed air tubes (91) look disorderly. During operation, the cutter (93) may unexpectedly cut the exposed air tubes (91) and cause the suction disks (91) to fail.

To overcome the shortcomings, the present invention provides a mechanical suction device to mitigate or obviate the aforementioned problems.

SUMMARY OF THE INVENTION

The main objective of the invention is to provide a mechanical suction device that easily attaches different sized workpieces to a work surface and prevents a cutter of a processing machine such as a milling device from unexpectedly cutting the suction device during operation.

A mechanical suction device in accordance with the present invention comprises a housing, multiple pneumatic cylinder assemblies, multiple air piston assemblies and a base.

The housing has a side, multiple top recesses, multiple bottom recesses, multiple longitudinal air passages and multiple transverse ports. The pneumatic cylinder assemblies are mounted on the side of the housing, and each has a cylinder and a shaft valve. The air piston assemblies are mounted in the housing, and each has an air piston mounted in one of the top recesses. The shaft valves are mounted slidably and respectively inside the transverse ports.

Other objectives, advantages and novel features of the invention will become more apparent from the following detailed description when taken in conjunction with the accompanying drawings.

DETAILED DESCRIPTION OF PREFERRED EMBODIMENT

Figure 1:
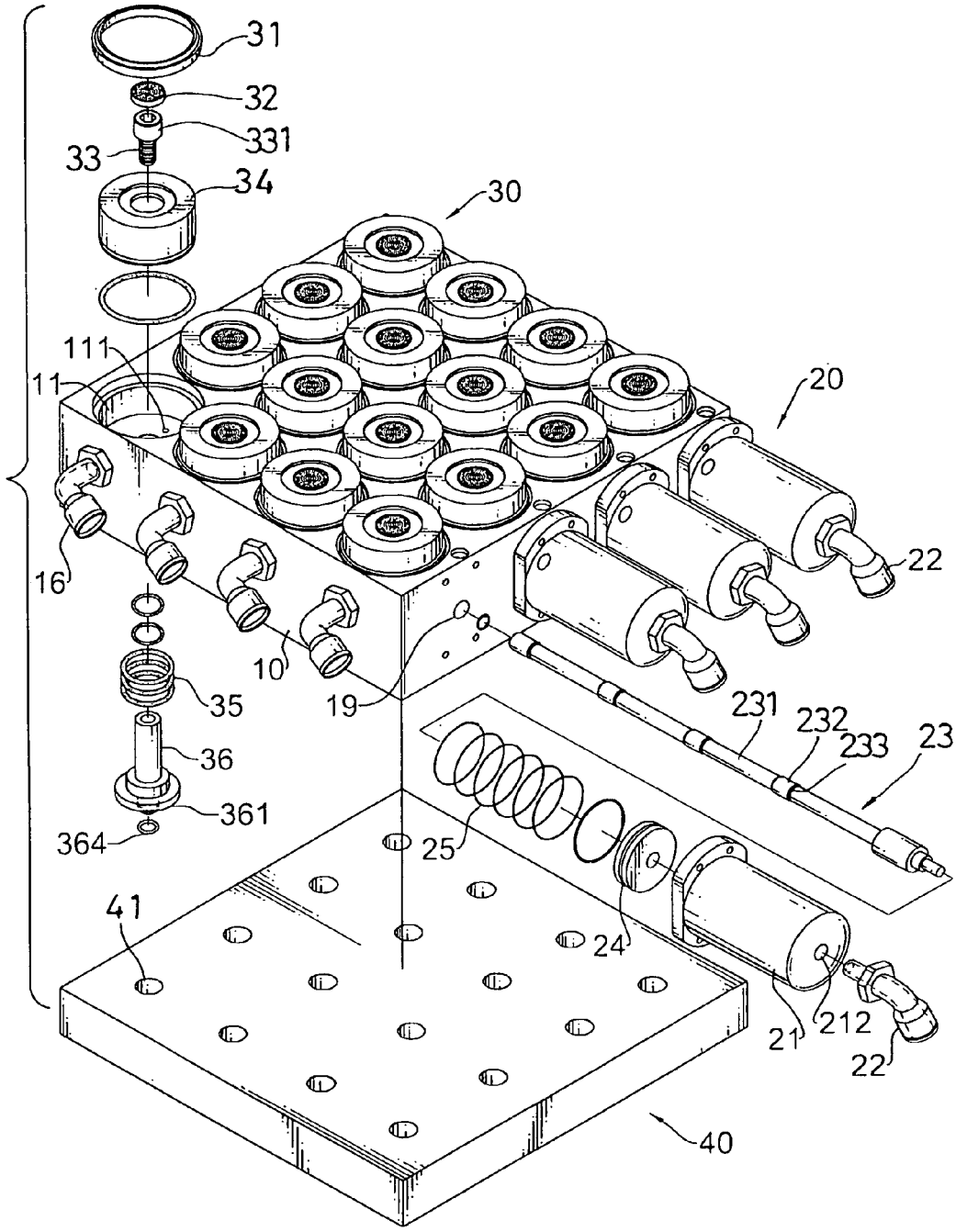
FIG. 1 is a partially exploded perspective view of a mechanical suction device in accordance with the present invention.
Figure 2:
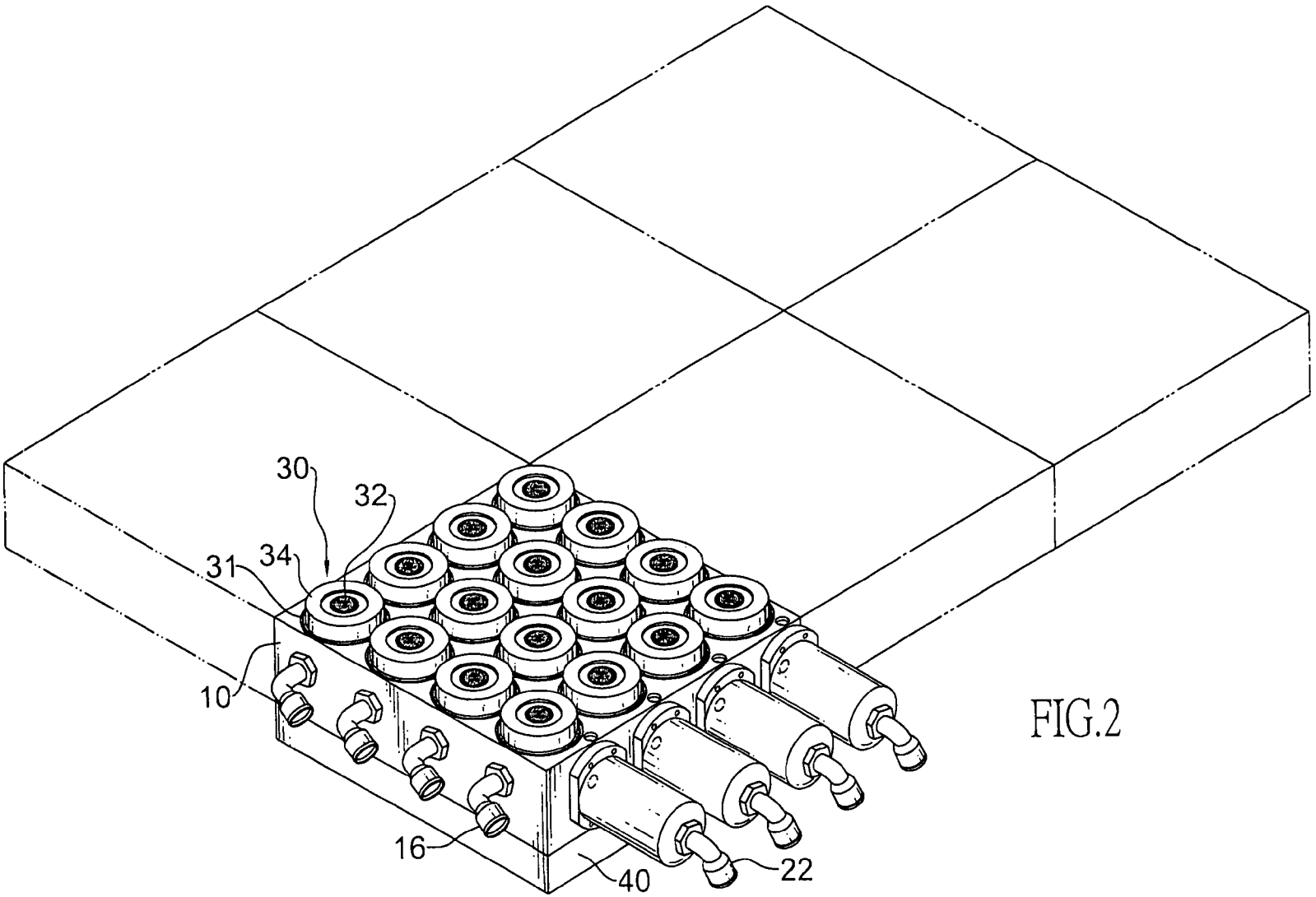
FIG. 2 is a perspective view of the mechanical suction device in FIG. 1.

With reference to FIGS. 1 and 2, a mechanical suction device in accordance with the present invention comprises a housing (10), multiple pneumatic cylinder assemblies (20), multiple air piston assemblies (30) and a base (40).

Figure 4:
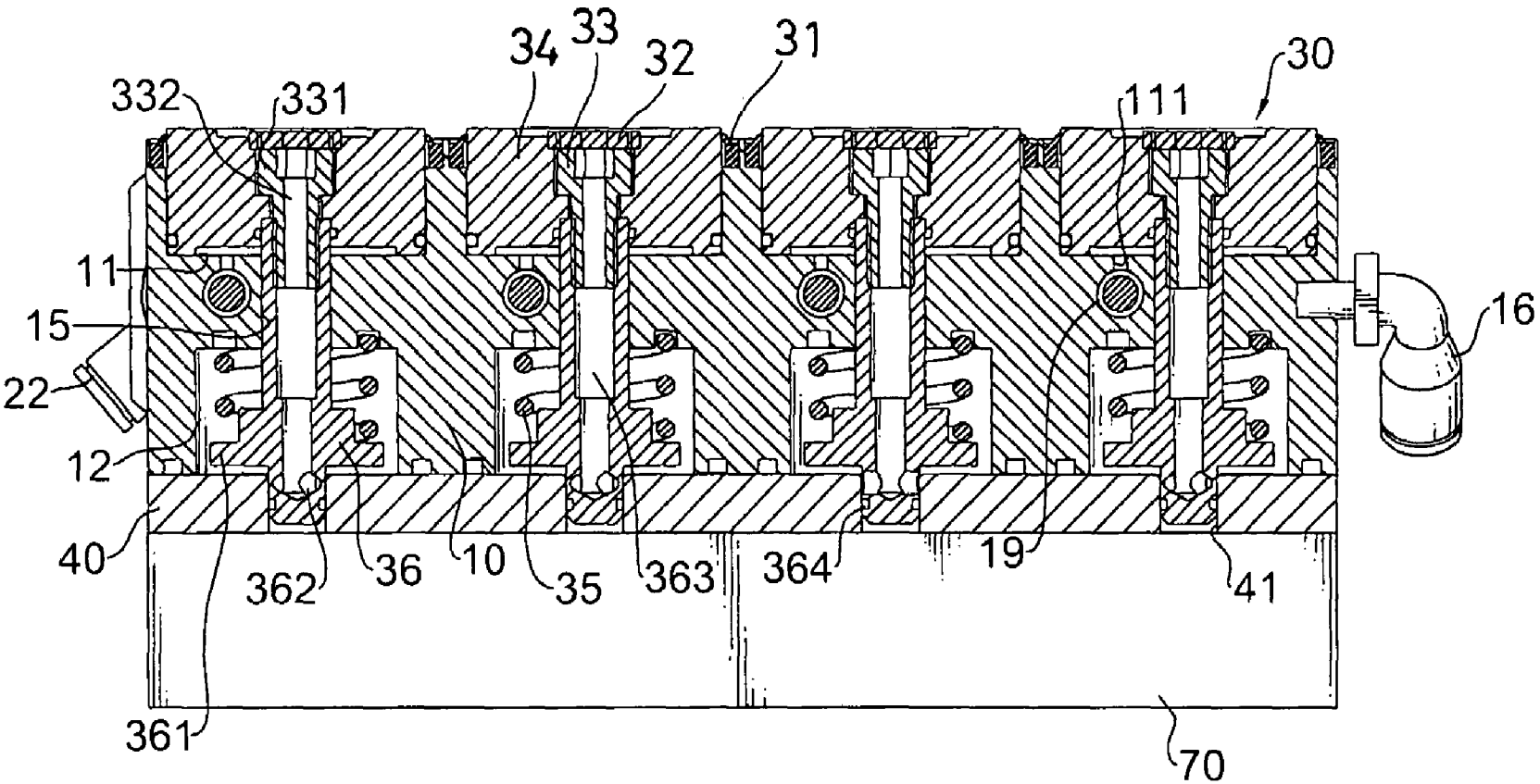
FIG. 4 is a right side view in partial section of the mechanical suction device in FIG. 2.
Figure 6:
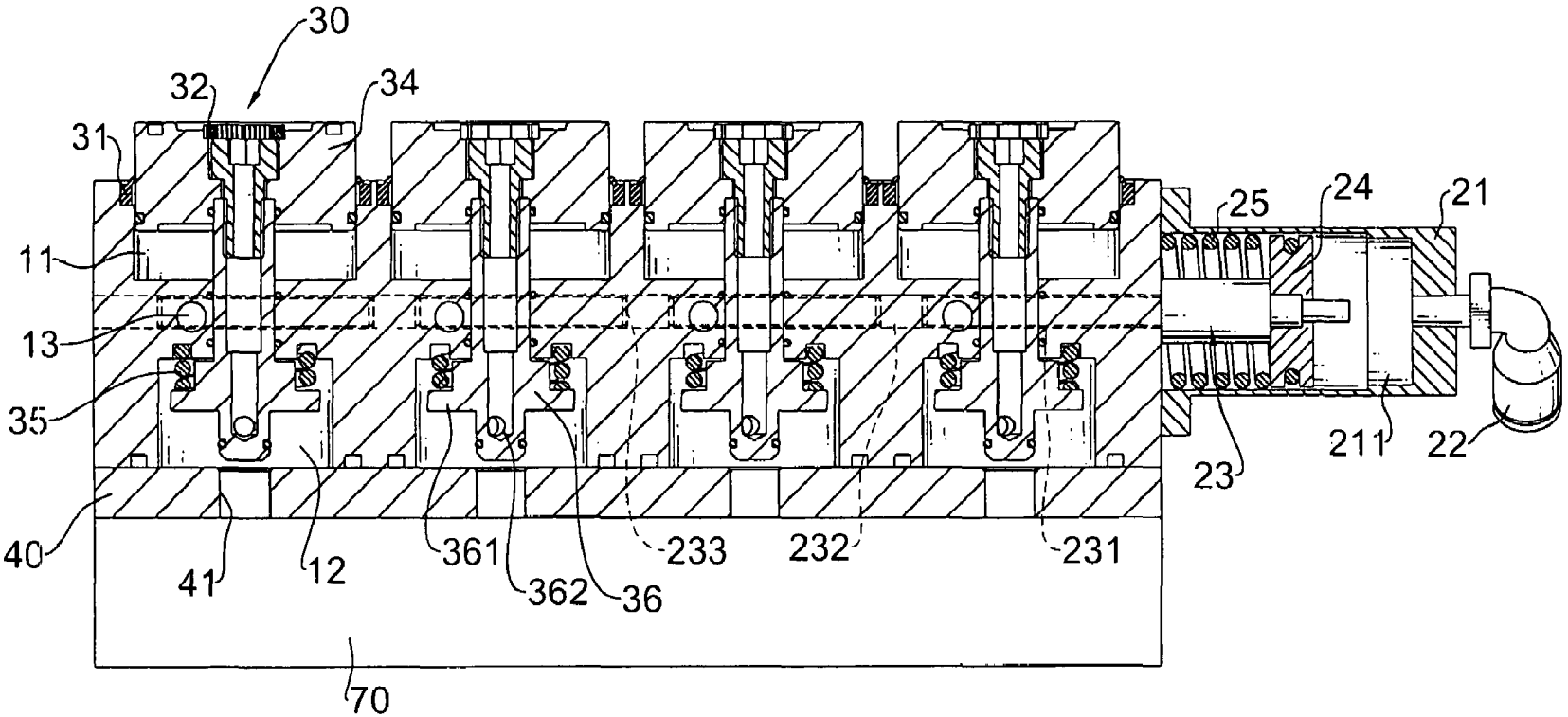
FIG. 6 is a front view in partial section of the mechanical suction device in FIG. 2.

With further reference to FIGS. 4 and 6, the housing (10) has a front, a top, a bottom, a right side, multiple top recesses (11), multiple bottom recesses (12), multiple medial passages (15), multiple longitudinal air passages (13), multiple transverse ports (19) and multiple longitudinal inlet tubes (16).

The top recesses (11) are defined in the top of the housing (10) and are arranged in multiple longitudinal rows, and the top recesses (11) in adjacent longitudinal rows form multiple transverse rows. Each top recess (11) has a bottom surface and an air inlet (111). The air inlet (111) is defined in the bottom surface of the top recess (11).

The bottom recesses (12) are defined in the bottom of the housing (10) and correspond respectively to the top recesses (11). Each bottom recess (12) has a top surface.

The medial passages (15) correspond to the top and bottom recesses (11, 12), are defined inside the housing (10) and communicate with and are mounted between the corresponding top and bottom recesses (11, 12).

The longitudinal air passages (13) are defined longitudinally through the housing (10) between the longitudinal rows of the top and bottom recesses (11, 12) and are aligned respectively with the longitudinal rows.

The transverse ports (19) are defined transversely through the housing (10), correspond to and are located respectively between transverse rows of the top and bottom recesses (11, 12). Each transverse port (19) crisscrosses and communicates with the longitudinal air passages (13), is formed below and communicates respectively with the air inlets (111) in the top recesses (11) in one transverse rows and has an inner diameter.

The longitudinal inlet tubes (16) are mounted on the front of the housing (10) and correspond respectively to the longitudinal air passages (13). Each longitudinal inlet tube (16) has an open proximal end, an open distal end and a through hole. The open proximal end is mounted through the front of the housing (10) and communicates with and is attached to a corresponding one of the longitudinal air passages (13). The through hole in the longitudinal inlet tube (16) is defined longitudinally through the longitudinal inlet tube (16) between the open proximal and distal ends.

The pneumatic cylinder assemblies (20) are mounted on the left side of the housing (10) and correspond respectively to the transverse ports (19). Each pneumatic cylinder assembly (20) has a cylinder (21), a transverse inlet tube (22), a shaft valve (23), a piston (24) and a spring (25).

The cylinder (21) is mounted on the left side of the housing (10) and has an open proximal end, a distal end, an inner chamber (211) and a port (212). The open proximal end of the cylinder (21) is mounted on the left side of the housing (10) and communicates with a corresponding one of the transverse ports (19). The inner chamber (211) communicates with the open proximal end of the cylinder (21). The port (212) is defined through the distal end of the cylinder (21) and communicates with the inner chamber (211).

The transverse inlet tube (22) is attached to the distal end of the cylinder (21), and each transverse inlet tube (22) has an open proximal end, an open distal end and a through hole. The open proximal ends of the transverse inlet tubes (22) are mounted respectively through the ports (212) in the distal ends of the cylinders (21) and communicate respectively with the inner chambers (211). The through hole in the transverse inlet tube (22) is defined from the open distal end of the transverse inlet tube (22) to the open proximal end of the transverse inlet tube (22).

Figure 3:
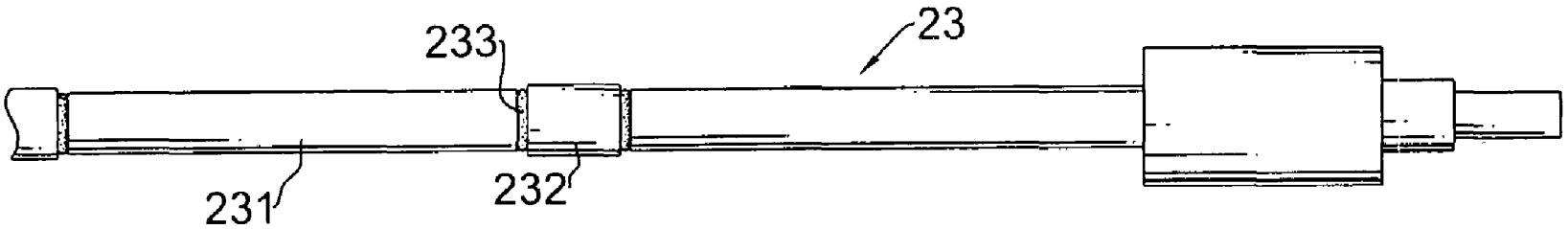
FIG. 3 is a side view of a shaft in the mechanical suction device in FIG. 1.

With further reference to FIG. 3, the shaft valve (23) is slidably mounted in a corresponding one of the transverse ports (19). The shaft valve (23) has an inner end, an outer end, multiple stems (231), multiple annular valve disks (232) and multiple pairs of O-rings (233). The stems (231) are formed on the shaft valve (23) at intervals and each stem (231) has an outer diameter smaller than the inner diameter of the transverse port (19). The annular valve disks (232) are formed respectively between adjacent stems (231) and correspond to and are aligned respectively with the air inlets (111) in the top recesses (11) in the corresponding transverse rows. Each annular valve disk (232) has two ends and an outer diameter. The outer diameter is larger than the outer diameter of the stem (231) and smaller than the inner diameter of the transverse port (19). The pairs of O-rings (233) correspond to the annular valve disks (232), and the O-rings (233) of each pair are mounted around the shaft valve (23) adjacent respectively to the ends of the annular valve disk (232) to isolate the air inlets (111) and selectively seal the air inlets (111) from the corresponding transverse ports (19).

The piston (24) is attached to the outer end of the shaft valve (23), is mounted slidably inside the inner chamber (211) and has an inside end and an outside end.

The spring (25) is mounted around the shaft valve (23) inside the cylinder (21) and has two ends respectively abutting the right side of the housing (10) and the distal end of the cylinder (21).

The air piston assemblies (30) correspond to the top and bottom recesses (11, 12) and are mounted in the housing (10), and each air piston assembly (30) has an air piston (34), a grease seal (31), a shaft (36), a spring (35), a bolt (33) and an optional breathable muffler (32).

The air piston (34) is slidably mounted respectively in a corresponding one of the top recesses (11), and each air piston (34) has a bottom, a through hole, an inner surface and an annular inner rib. The annular inner rib is formed on the inner surface of the air piston (34) and has a top surface and a bottom surface.

The grease seal (31) is mounted securely inside the top recess (11) around the air piston (34).

The shaft (36) is slidably mounted in the bottom recess (12) through the medial passage (15) and extends into the through hole in the air piston (34). The shaft (36) has a sidewall, a top end, a bottom end, an air-suction passage (363), an inner thread, a side hole (362), an annular flange (361) and an O-ring (364). The top end of the shaft (36) abuts the bottom surface of the annular inner rib in the air piston (34). The air-suction passage (363) is defined in the top end of the shaft (36) and communicates with the through hole in the air piston (34). The inner thread is formed on the inner surface inside the air-suction passage (363) in the shaft (36). The side hole (362) is defined through the sidewall and communicates with the air-suction passage (363) in the shaft (36). The annular flange (361) is formed around the sidewall between the side hole (362) and the top end of the shaft (36) and has a top surface and a bottom surface. The O-ring (364) is mounted around the sidewall of the shaft (36) below the annular flange (361) adjacent to the bottom end of the shaft (36).

The spring (35) is mounted around the shaft (36) and has two ends respectively abutting the top surface of the bottom recess (12) and the top surface of the annular flange on the shaft (36).

The bolt (33) is mounted inside the through hole in the air piston (34) on the top end of the shaft (36) and has a top end, a head (331), an outer surface, an outer thread and an air hole (332). The head (331) is formed on the top end of the bolt (33) and abuts the top surface of the annular inner rib of the air piston (34). The outer thread is formed on the outer surface of the bolt and screws into the inner thread in the shaft (36). The air hole (332) is defined through the bolt (33) and communicates with the air-suction passage (363) in the shaft (36).

The breathable muffler (32) is made of a breathable material, is mounted in the through hole in the air piston (34) and abuts the head (331) of the bolt (33).

The base (40) is mounted on the bottom of the housing (10) and has multiple through holes (41). The through holes (41) correspond respectively to the shafts (36) and allow the bottom ends of the shafts (36) with the O-rings (364) to selectively extend into the through holes (41) to close the through holes (41). With specific reference to FIG. 2, the mechanical suction devices can mount with each other and be arranged in an array to be applied to a workpiece with a large size.

Figure 5:
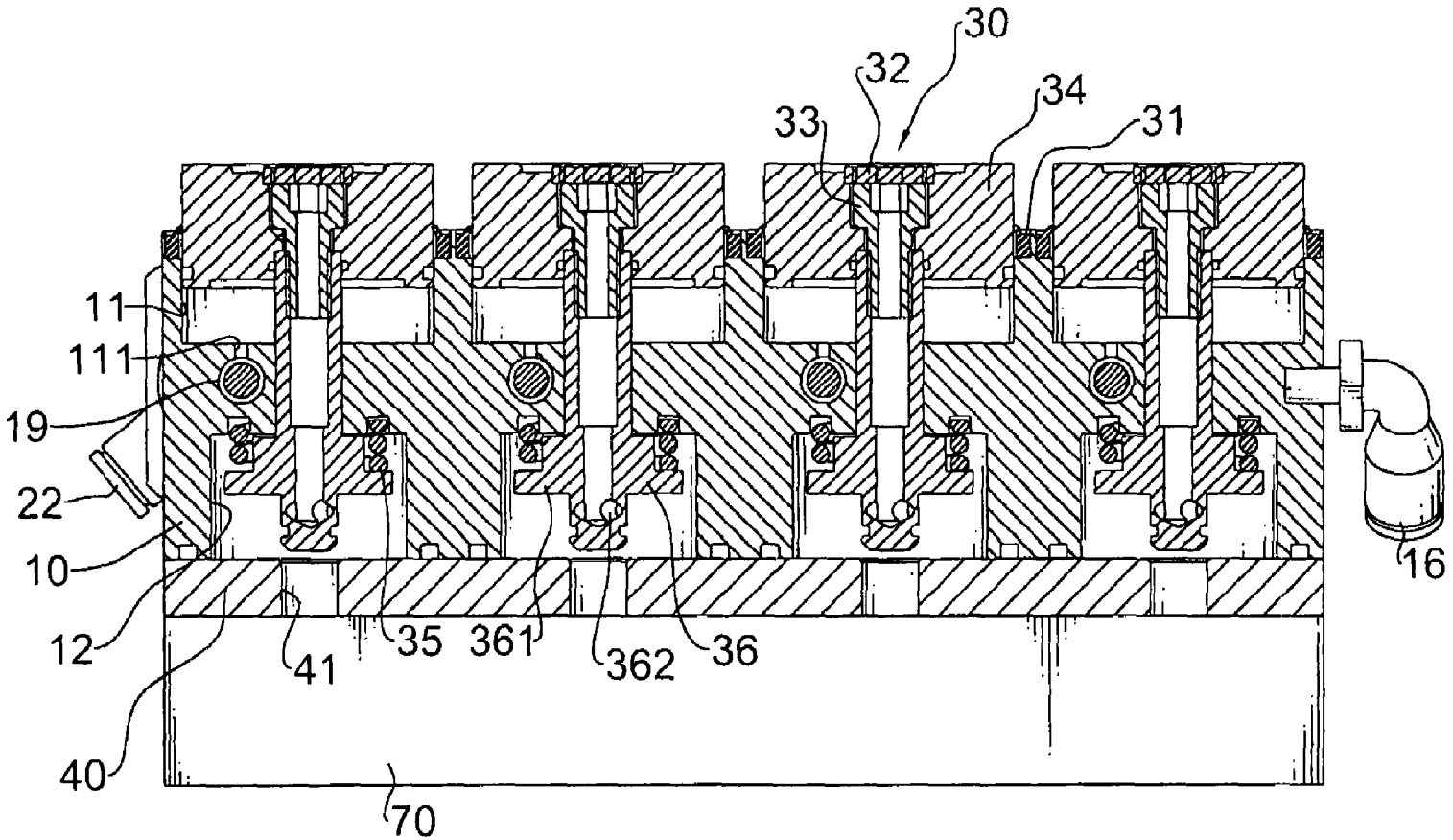
FIG. 5 is an operational right side view in partial section of the mechanical suction device in FIG. 4.

With reference to FIGS. 4, 5 and 6, the mechanical suction device in accordance with the present invention is used with a worktable (70), an air compressor and a processing machine such as a milling device having a cutter to process one or multiple workpieces. The air compressor provides compressed air to the longitudinal and transverse inlet tubes (16, 22).

The compressed air passing into the transverse inlet tubes (22) pushes the pistons (24) against an elastic force of the springs (25) toward the right side of the housing (10). The shaft valves (23) in response to the pistons (25) move left inside the transverse ports (19) and cause the stems (231) to align respectively with the air inlets (111). Therefore, the air inlets (111) communicate with the corresponding transverse ports (19).

The compressed air passing into the longitudinal inlet tubes (16) flows through the corresponding longitudinal air passages (13) into the transverse ports (19) and then spray out of the air inlets (111) to push against the bottoms of the corresponding air pistons (34). The air pistons (34) are raised by the compressed air and draw the corresponding shafts (36) to lift against an elastic force of the spring (35). The bottom ends of the shafts (36) move upward out respectively of the corresponding through holes (41), and the side holes (362) of the shafts (36) communicate respectively with the through holes (41). Then the workpieces are put on the raised air pistons (34).

The worktable (70) generates a vacuum suction through the through hole (41), the air-suction passage (363), the side hole (362) in the shaft (36), the air hole (332) of the bolt (332) and the breathable muffle (32). Then the workpieces are held by the vacuum suction on the air pistons (34).

When the supply of compressed air to the transverse inlet tubes (22) stops and compressed air is supplied to the inlet tubes (16), the pistons (24) with the shaft valves (23) return to their original positions by the elastic force of the springs (25). The annular valve disks (232) of the shaft valves (23) are aligned respectively with the corresponding air inlets (111) and the pairs of the O-rings (233) break the communication between the air inlets (111) and the corresponding transverse ports (19). Because the outer diameters of the annular valve disks (232) and stems (231) on the shaft valves (23) are both smaller than the inner diameter of the transverse ports (19), the compressed air inside one of the longitudinal air passages (13) passes through gaps between the shaft valves (23) and the corresponding transverse ports (19). Therefore, the compressed air fills all of the longitudinal air passages (13) and transverse ports (19).

Figure 7:
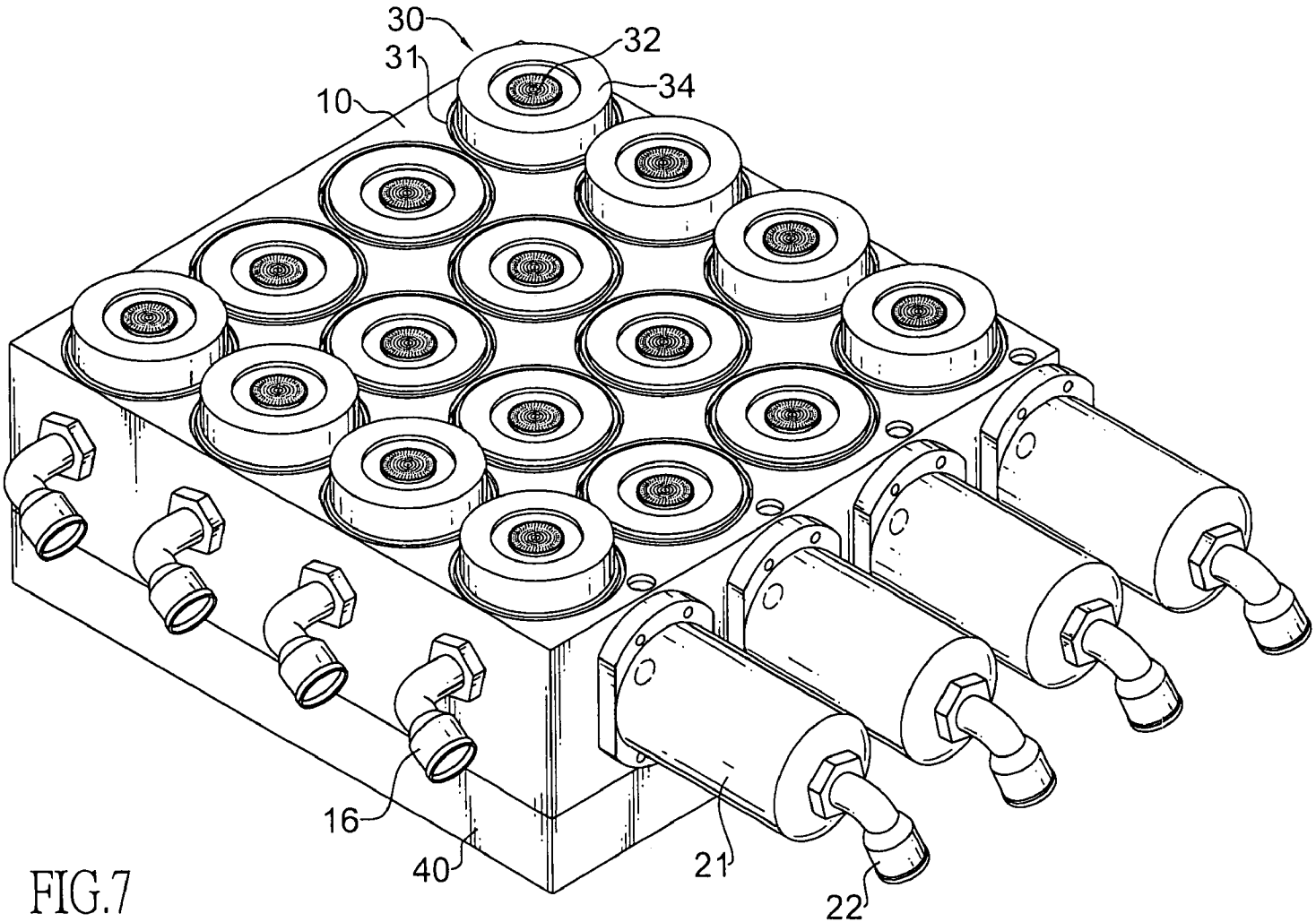
FIG. 7 is an operational perspective view of the mechanical suction device in FIG. 2 with several air pistons raised.
Figure 8:
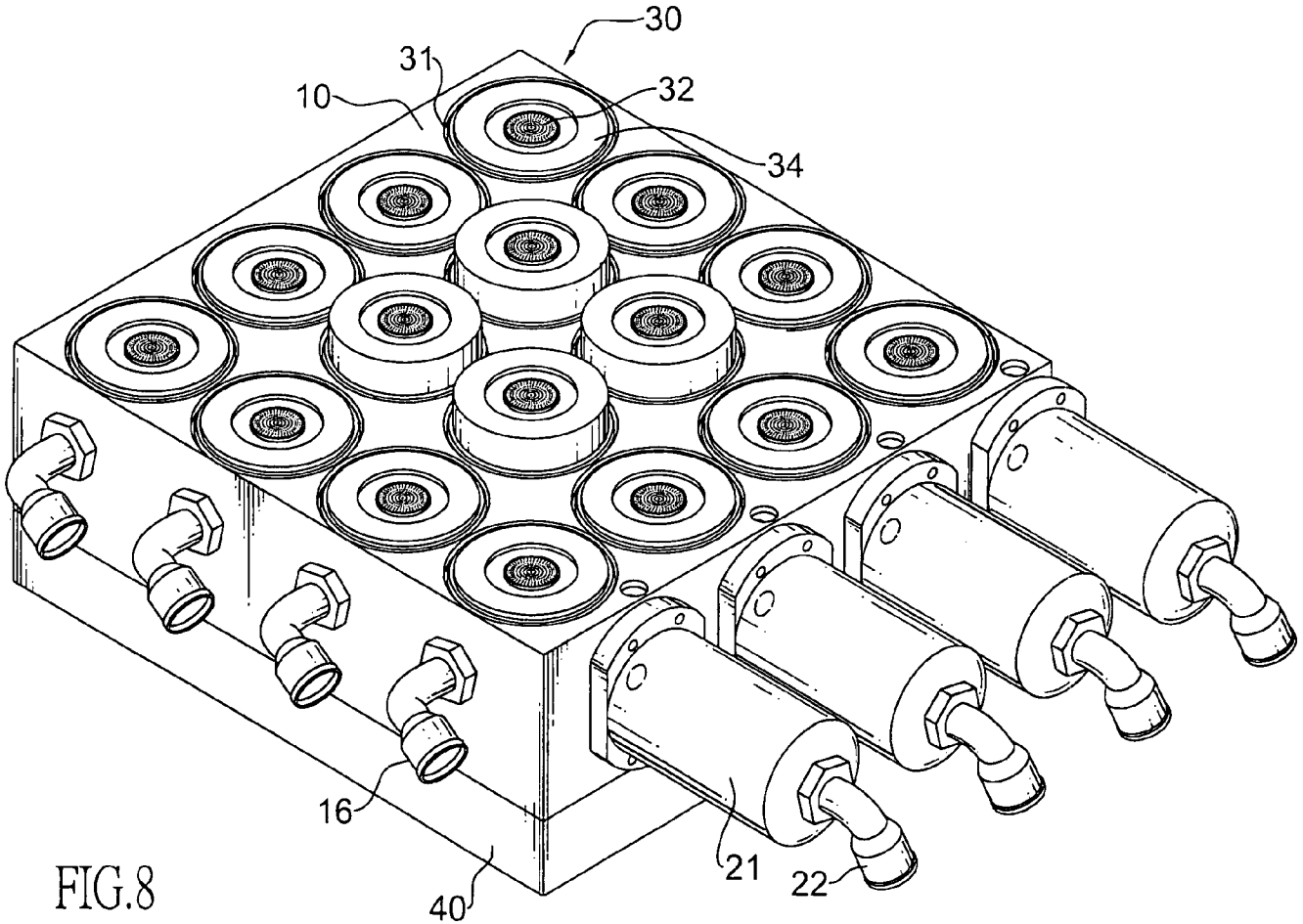
FIG. 8 is an operational perspective view of the mechanical suction device in FIG. 2 with other air pistons raised.
Figure 9:
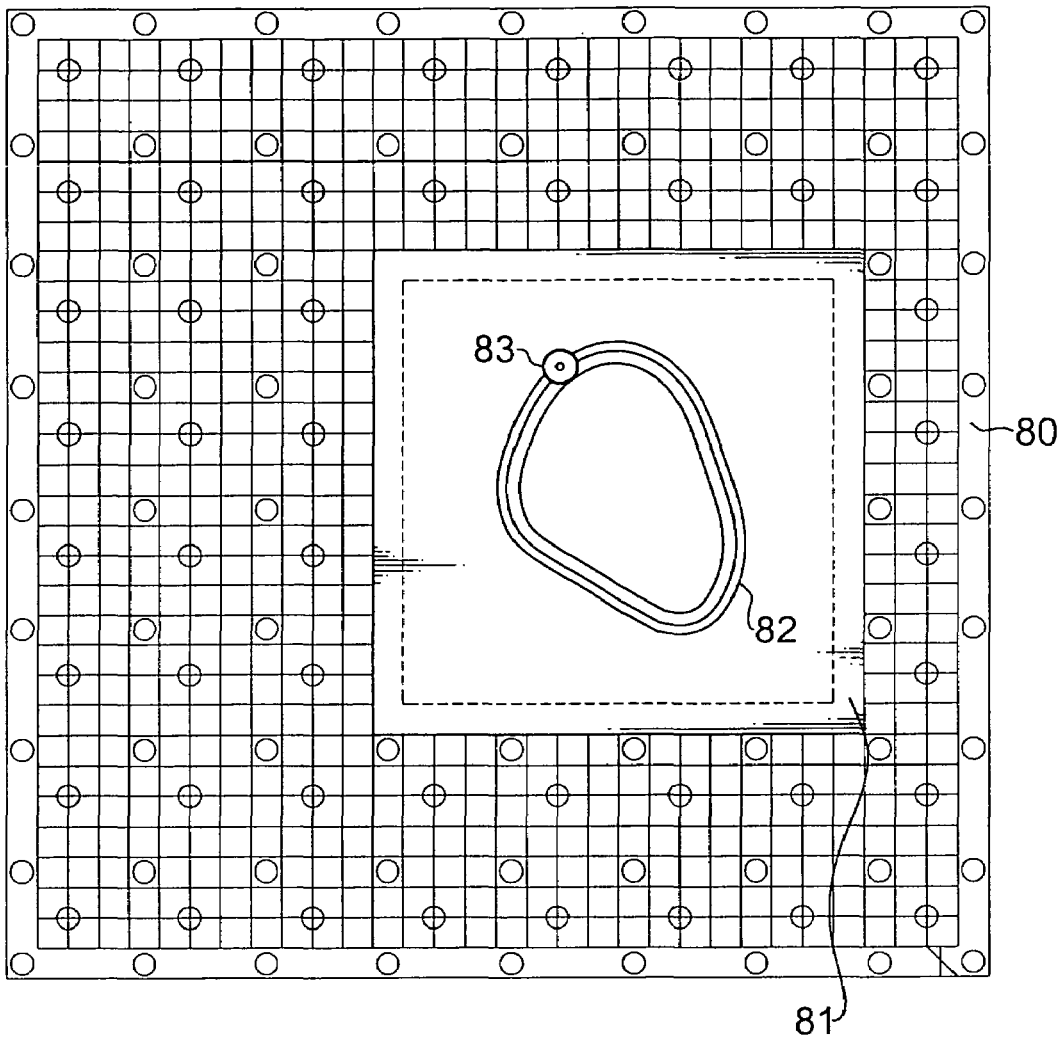
FIG.9 PRIOR ART
FIG. 9 is a top view of a workpiece, a cutter and a conventional jig assembly in accordance with the prior art.
Figure 10:
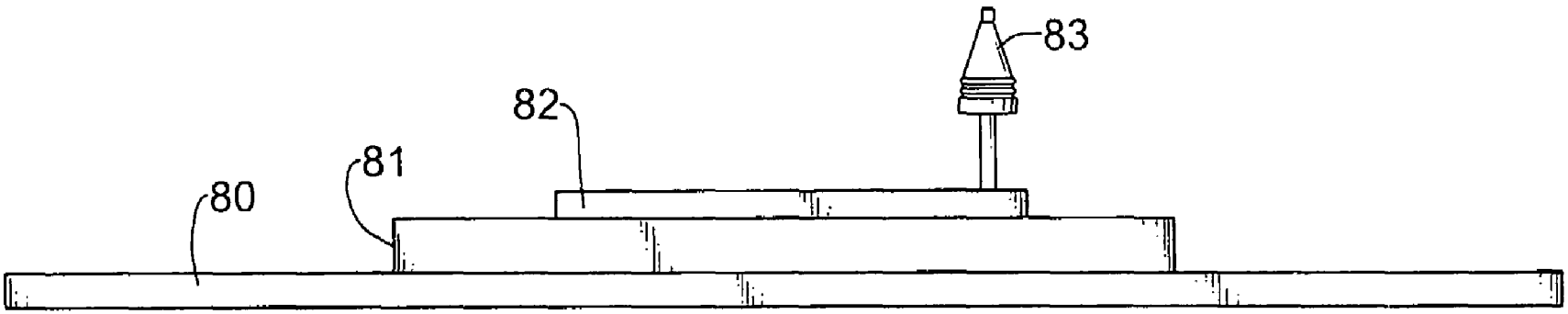
FIG.10 PRIOR ART
FIG. 10 is a side view of the workpiece, the cutter and the conventional jig assembly in FIG. 9.
Figure 11:
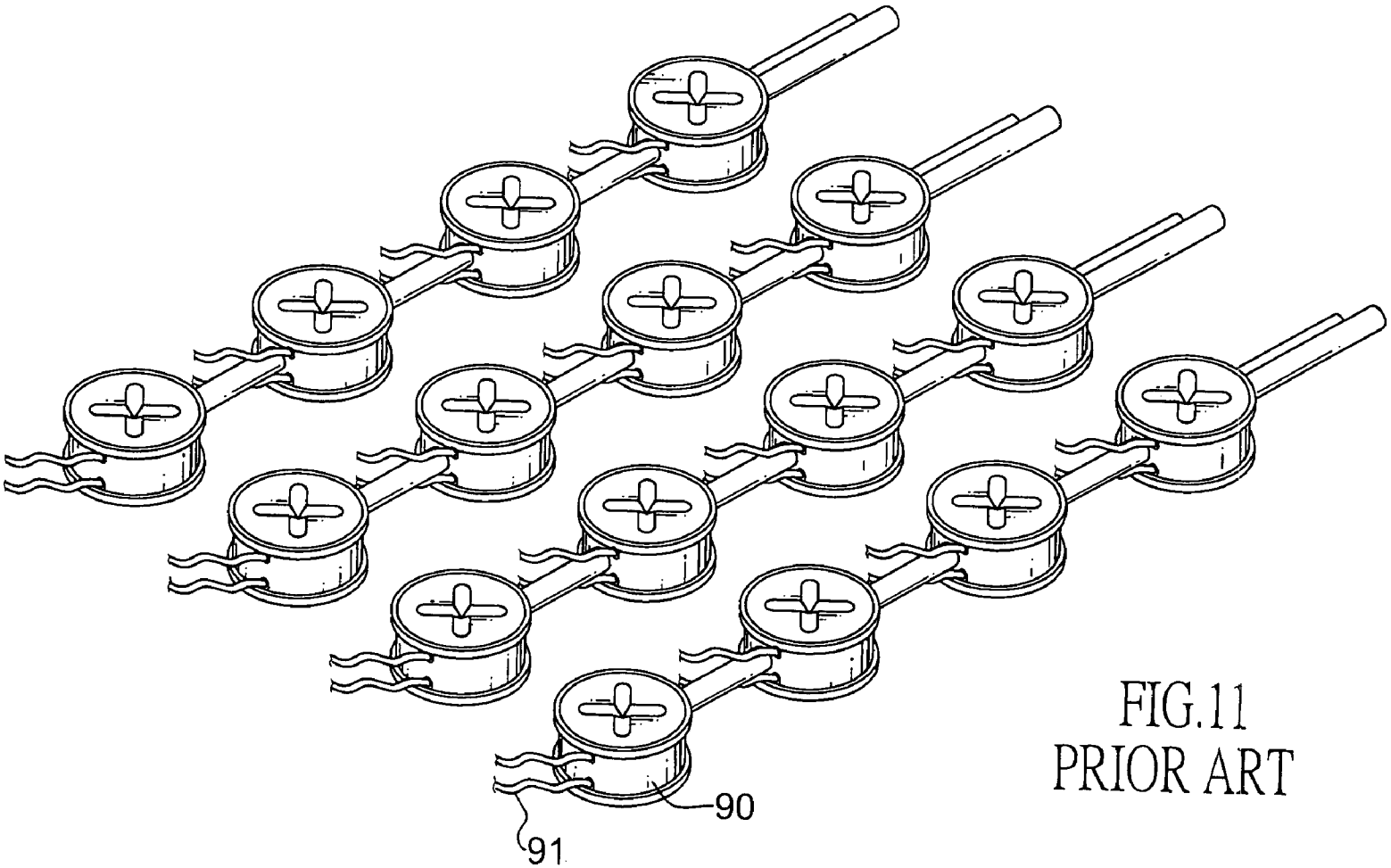
FIG.11 PRIOR ART
FIG. 11 is a perspective view of a conventional suction disk assembly in accordance with the prior art.
Figure 12:
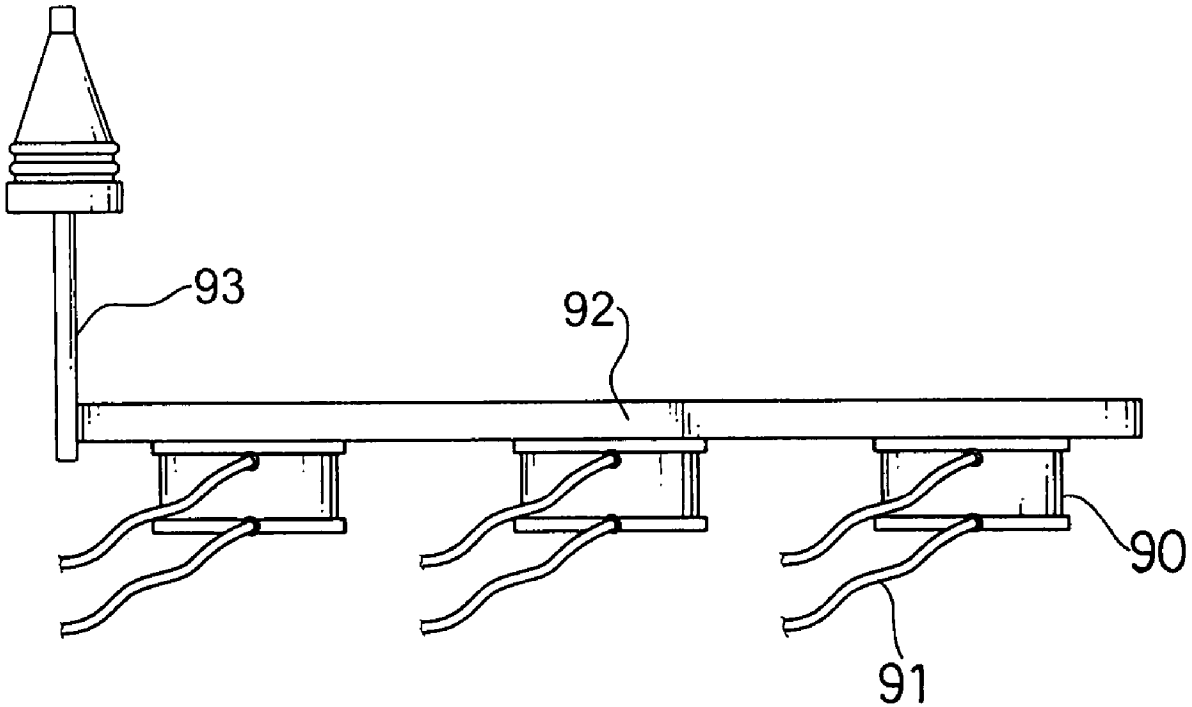
FIG.12 PRIOR ART
FIG. 12 is a side view of a workpiece, a cutter and the suction disk assembly in FIG. 11.

With reference to FIGS. 7 and 8, selective air piston (34) can be raised by supplying compressed air to appropriate longitudinal inlet tubes (16) and transverse inlet tubes (22). Workpieces of different sizes can be easily held by the air pistons (34) without other procedures.

With the longitudinal air passages (13) and the transverse ports (19) defined inside the housing (10) and the pneumatic cylinder assemblies (20) and the longitudinal inlet tubes (16) mounted on the front and right side of the housing (10), the mechanical suction device is damaged hardly by a processing machine cutter operating above the device (10).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mechanical suction device comprising:

a housing having a front;

a top;

a bottom;

a side;

multiple top recesses defined in the top of the housing, arranged in multiple longitudinal rows and simultaneously in transverse rows, and each top recess having a bottom surface and an air inlet defined in the bottom surface of the top recess;

multiple bottom recesses defined in the bottom of the housing and corresponding to the top recesses, and each bottom recess having a top surface;

multiple medial passages corresponding to the top and bottom recesses, defined inside the housing and communicating with and mounted between the corresponding top and bottom recesses;

multiple longitudinal air passages defined longitudinally through the housing between the longitudinal rows of the top and bottom recesses;

multiple transverse ports defined transversely through the housing, corresponding to and located respectively between the transverse rows of the top and bottom recesses, and each transverse port crisscrossing and communicating with the longitudinal air passages, formed below and communicating respectively with the air inlets in the top recesses in one of the corresponding transverse rows and having an inner diameter; and multiple longitudinal inlet tubes mounted on the front of the housing and corresponding respectively to the longitudinal air passages, and each longitudinal inlet tube having an open proximal end mounted through the front of the housing and communicating with and attached to a corresponding one of the longitudinal air passages;

an open distal end; and a through hole defined longitudinally through the longitudinal inlet tube between the open proximal and distal ends;

multiple pneumatic cylinder assemblies mounted on the left side of the housing and corresponding respectively to the transverse ports, and each pneumatic cylinder assembly having a cylinder mounted on the side of the housing and having an open proximal end mounted on the side of the housing and communicating with a corresponding one of the transverse ports;

a distal end;

an inner chamber communicating with the open proximal end of the cylinder; and a port defined through the distal end of the cylinder and communicating with the inner chamber;

a transverse inlet tube attached to the distal end of the cylinder and having an open proximal end mounted through the port at the distal end of the cylinder and communicating with the inner chamber;

an open distal end; and a through hole defined from the open distal end of the transverse inlet tube to the open proximal end of the transverse inlet tube;

a shaft valve mounted slidably in a corresponding one of the transverse ports and having an inner end;

an outer end;

multiple stems formed on the shaft valve at intervals, and each stem having an outer diameter; and multiple annular valve disks formed respectively between adjacent stems and corresponding to and aligned respectively with the air inlets in the top recesses in the corresponding transverse row, and each annular valve disk having two ends and an outer diameter larger than the outer diameter of the stem;

a piston attached to the outer end of the shaft valve, mounted slidably inside the inner chamber and having an inside end and an outside end; and a spring mounted around the shaft valve inside the cylinder and having two ends respectively abutting the side of the housing and the distal end of the cylinder;

multiple air piston assemblies corresponding to the top and bottom recesses and mounted in the housing, and each air piston assembly having an air piston mounted slidably in a corresponding one of the top recesses and having a bottom;

a through hole;

an inner surface; and an annular inner rib formed on the inner surface of the air piston and having a top surface and a bottom surface;

a shaft mounted slidably in the bottom recess through the medial passage, extending into the through hole of the air piston and having a sidewall;

a top end abutting the bottom surface of the annular inner rib in the air piston;

a bottom end;

an air-suction passage defined in the top end of the shaft and communicating with the through hole of the air piston;

an inner thread formed on the inner surface inside the air-suction passage in the shaft;

a side hole defined through the sidewall and communicating with the air-suction passage in the shaft; and an annular flange formed around the sidewall between the side hole and the top end of the shaft and having a top surface and a bottom surface;

a spring mounted around the shaft and having two ends respectively abutting the top surface of the bottom recess and the top surface of the annular flange on the shaft; and a bolt mounted inside the through hole in the air piston on the top end of the shaft and having a top end;

a head formed on the top end of the bolt and abutting the top surface of the annular inner rib of the air piston;

an outer surface;

an outer thread formed on the outer surface of the bolt and screwing into the inner thread in the shaft; and an air hole defined through the bolt and communicating the air-suction passage in the shaft; and a base mounted on the bottom of the housing and has multiple through holes corresponding respectively to the shafts and respectively allowing the bottom ends of the shafts to extend into the through holes to close the through holes.

2. The mechanical suction device as claimed in claim 1, wherein each air piston assembly further has a grease seal mounted securely inside the corresponding top recess around the air piston.

3. The mechanical suction device as claimed in claim 2, wherein each air piston assembly further has a breathable muffler made of a breathable material, mounted in the through hole of the air piston and abutting the head of the bolt.

4. The mechanical suction device as claimed in claim 1, wherein the shaft of each air piston assembly further has an O-ring mounted around the sidewall of the shaft below the annular flange adjacent to the bottom end of the shaft.

5. The mechanical suction device as claimed in claim 1, wherein the shaft valve of each pneumatic cylinder assembly further has multiple pairs of O-rings corresponding to the annular valve disks, wherein the O-rings of each pair are mounted around the shaft valve adjacent respectively to the ends of the annular valve disk.

* * * * *